US010197028B2

(12) United States Patent
Yasukawa et al.

(10) Patent No.: US 10,197,028 B2
(45) Date of Patent: Feb. 5, 2019

(54) FUEL INJECTOR

(71) Applicant: Hitachi Automotive Systems, Ltd., Hitachinaka-shi, Ibaraki (JP)

(72) Inventors: Yoshihito Yasukawa, Tokyo (JP); Takao Miyake, Hitachinaka (JP); Atsushi Nakai, Hitachinaka (JP); Masashi Sugaya, Hitachinaka (JP); Akiyasu Miyamoto, Tokyo (JP); Kiyotaka Ogura, Hitachinaka (JP); Motoyuki Abe, Tokyo (JP)

(73) Assignee: HITACHI AUTOMOTIVE SYSTEMS, LTD, Hitachinaka-Shi (JP)

( * ) Notice: Subject to any disclaimer, the term of this patent is extended or adjusted under 35 U.S.C. 154(b) by 48 days.

(21) Appl. No.: 15/502,351

(22) PCT Filed: Jul. 1, 2015

(86) PCT No.: PCT/JP2015/068934

§ 371 (c)(1),
(2) Date: Feb. 7, 2017

(87) PCT Pub. No.: WO2016/042881

PCT Pub. Date: Mar. 24, 2016

(65) Prior Publication Data

US 2017/0241389 A1 Aug. 24, 2017

(30) Foreign Application Priority Data

Sep. 18, 2014 (JP) ..... 2014-189511

(51) Int. Cl.

| | |
|---|---|
| ***F02M 51/06*** | (2006.01) |
| ***F02M 61/20*** | (2006.01) |
| ***F02M 61/04*** | (2006.01) |

(52) U.S. Cl.
CPC ..... *F02M 51/061* (2013.01); *F02M 51/06* (2013.01); *F02M 51/0625* (2013.01);
(Continued)

(58) Field of Classification Search
CPC .. F02M 51/06; F02M 51/061; F02M 51/0625; F02M 51/0628; F02M 51/0635;
(Continued)

(56) References Cited

U.S. PATENT DOCUMENTS 6,808,133 B1 * 10/2004 Stier ..... F02M 51/0614 239/585.1
2007/0235669 A1 10/2007 Suzuki et al.

FOREIGN PATENT DOCUMENTS

| | | | |
|---|---|---|---|
| JP | 2006-97659 | A | 4/2006 |
| JP | 2007-278218 | A | 10/2007 |
| JP | 2011-137442 | A | 7/2011 |

* cited by examiner

*Primary Examiner* — Darren W Gorman
(74) *Attorney, Agent, or Firm* — Foley & Lardner LLP

(57) ABSTRACT

A fuel injector is provided. A movable iron core is provided relatively displaceable to a valve body. A fixed iron core is opposed to the movable iron core. A first spring member energizes the valve body in a valve closing direction. A second spring member energizes the movable iron core in a valve closing direction. Contact portions are in contact with each other in a case where the movable iron core displaces in a valve opening direction with respect to the valve body. A gap is formed between the contact portions in a valve closing state. In a state in which the movable iron core and the valve body move in different directions after the movable iron core collides with the fixed iron core while a valve is opened, a spring force is not applied between the movable iron core and the valve body.

8 Claims, 5 Drawing Sheets

(52) U.S. Cl.
CPC ..... *F02M 61/04* (2013.01); *F02M 61/20* (2013.01); *F02M 2200/50* (2013.01)

(58) Field of Classification Search
CPC ..... F02M 51/066; F02M 61/04; F02M 61/20; F02M 61/205
See application file for complete search history.

FUEL INJECTOR

TECHNICAL FIELD

The present invention relates to a fuel injector which is used in an internal combustion engine and mainly injects a fuel.

BACKGROUND ART

A background art in this technique field is described in JP 2011-137442 A (PTL 1). A fuel injection valve is described in PTL 1. The fuel injection valve includes a coil, a valve member, and a movable stopper (refer to ABSTRACT). The coil generates a magnetic attractive force by energization in a valve opening motion to open an injection hole and eliminates the magnetic attractive force by stopping the energization by a valve closing motion to close the injection hole. The valve member includes a valve penetrating portion penetrating a movable core and a valve protruding portion protruding in a diameter direction from the valve penetrating portion and capable of being in a contact with the movable core from a fixing core side. The valve member intermittently continues fuel injection by opening and closing the injection hole by reciprocating movement. The movable stopper includes a stopper penetrating portion protruding from an end surface on the fixing core side of the movable core by penetrating the movable core. The movable stopper forms a gap between the valve protruding portion and the movable core by bringing the stopper penetrating portion into contact with the valve protruding portion from a side opposite to the fixing core in a state in which energization to the coil is stopped.

In the fuel injection valve, the movable core moves in the gap formed between the valve protruding portion and the movable core by the movable stopper without accompanying a valve member, and the accelerated movable core collides with the valve protruding portion. An impact force is applied to the valve protruding portion in accordance with a momentum of the movable core as of the collision, and a moving time of the valve member for a distance needed to open the injection hole can be shortened (refer to paragraph 0011).

CITATION LIST

Patent Literature

PTL 1: JP 2011-137442 A

SUMMARY OF INVENTION

Technical Problem

A fuel injector is required to promote atomization of spraying and to stabilize an injection amount. A deterioration factor of the spray atomization is that a fuel flow rate is reduced during a low lift period in which a valve member (hereinafter called a valve body) starts to open. A deterioration factor of the stabilization of an injection amount is that convergence of a valve motion after a valve is opened is slow. Therefore, the fuel injector increases a speed of the valve body starting to open, and at the same time, it is necessary to immediately converge a motion of the valve body after the valve is opened. In a fuel injection valve described in PTL 1, a gap is provided in a displacement direction between a movable core (hereinafter called a movable iron core) and a valve body. Consequently, while the movable iron core moves in the gap, only the movable iron core is moved. As a result, an impact force acts on the valve body by making the accelerated movable iron core collide with the valve body, and a low lift period is shortened. Further, by providing a movable stopper between the movable iron core and the valve body, the valve body and the movable iron core can be relatively moved, and an injection amount is stabilized.

However, the movable stopper slides with both of a valve body and a movable iron core, and when the valve body and the movable iron core relatively move, a force is always exerted to each other. PTL 1 does not disclose a viewpoint that a relatively acting force is separated, and it is limited to accelerate convergence of a valve body behavior.

Therefore, an object of the present invention is to provide a fuel injector. In the fuel injector, an impact force is applied from a movable iron core to a valve body when a valve is opened. The fuel injector can promote stabilization of an injection amount by immediately converging a motion of the valve body when the valve is opened.

Solution to Problem

To achieve the above-described object, a fuel injector according to the present invention includes a gap, a first spring, an intermediate member, and a second spring in a state in which a valve is closed. The gap is provided in a displacement direction between abutting surfaces of a valve body and a movable iron core. The first spring energizes the valve body in a downstream direction. The intermediate member includes a surface being in contact with the movable iron core at a downstream position between the valve body and the movable iron core. The second spring energizes an upstream-side end surface of the intermediate member in a downstream direction and is supported by the valve body on an upstream side. In a state in which the valve body and the movable iron core move in a different direction after the movable iron core collides with a fixed iron core, a spring force between the movable iron core and the valve body are separated.

Advantageous Effects of Invention

According to a configuration of the present invention, during a bounding motion in which a fixed iron core collides with a movable iron core after a valve is opened, and the movable iron core and the valve body move in an opposite direction once the valve opening motion has been completed, spring forces are separated each other, and mutual motions do not apply a force to each other. Therefore, an oscillation behavior is stabilized, bounding of a movable component is immediately converged, and stabilization of a fuel injection amount can be promoted.

DESCRIPTION OF EMBODIMENTS

Embodiments according to the present invention will be described below.

First Embodiment

Figure 1:
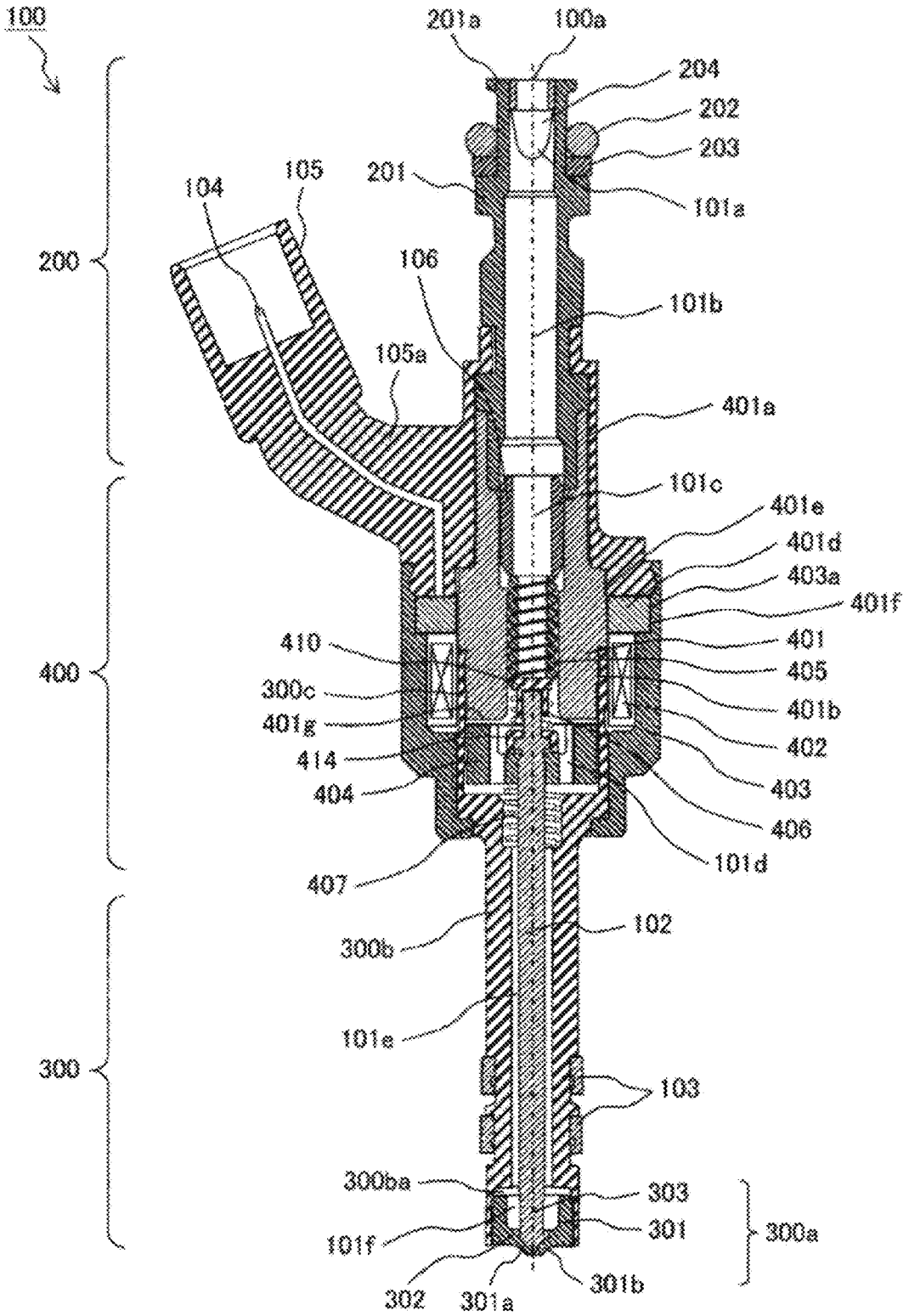
FIG. 1 is a sectional view illustrating a structure of a fuel injector according to a first embodiment of the present invention and is a vertical sectional view illustrating a cut surface parallel to a central axis line 100*a*.
Figure 2:
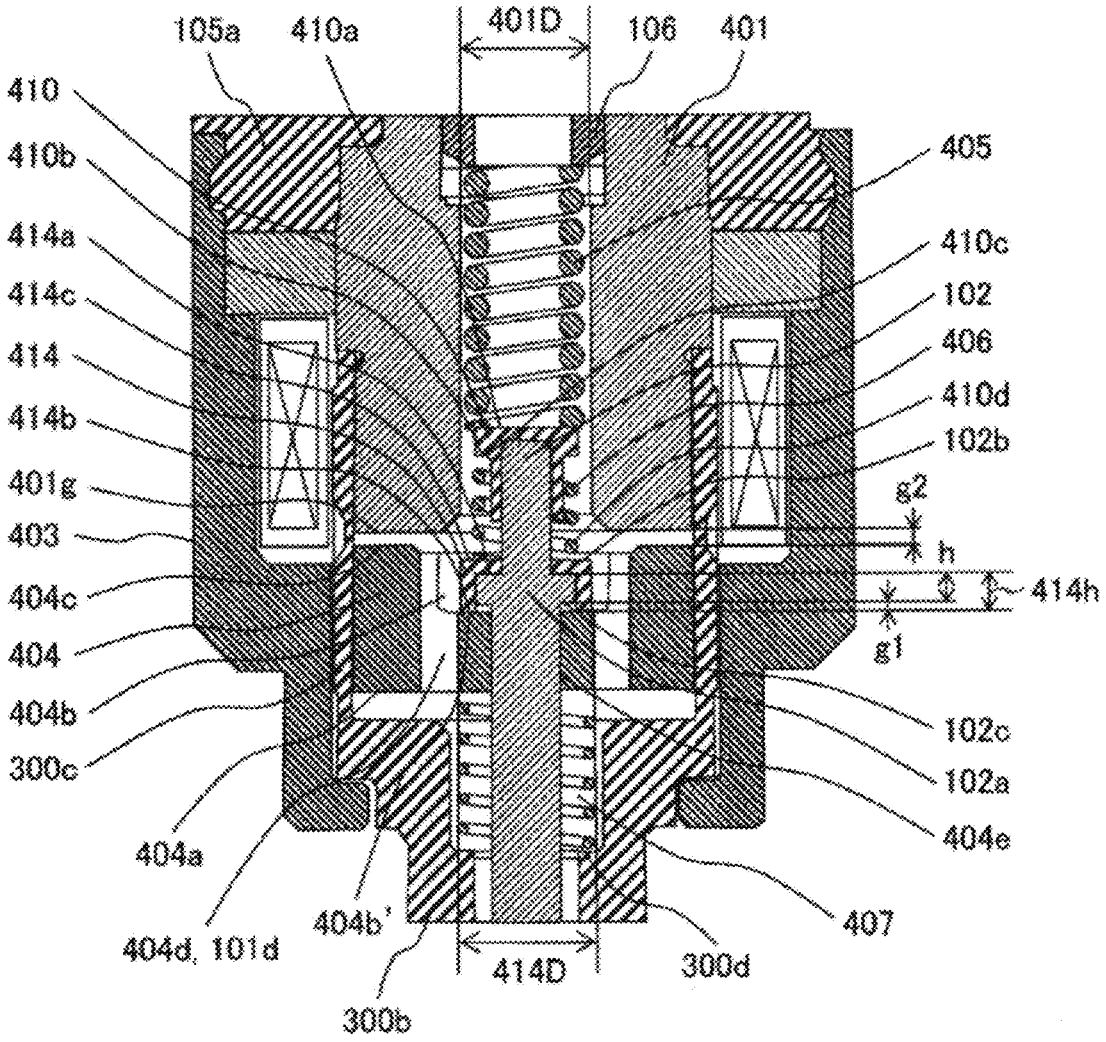
FIG. 2 is a sectional view enlarging an electromagnetic driving unit of the fuel injector illustrated in FIG. 1.
Figure 3:
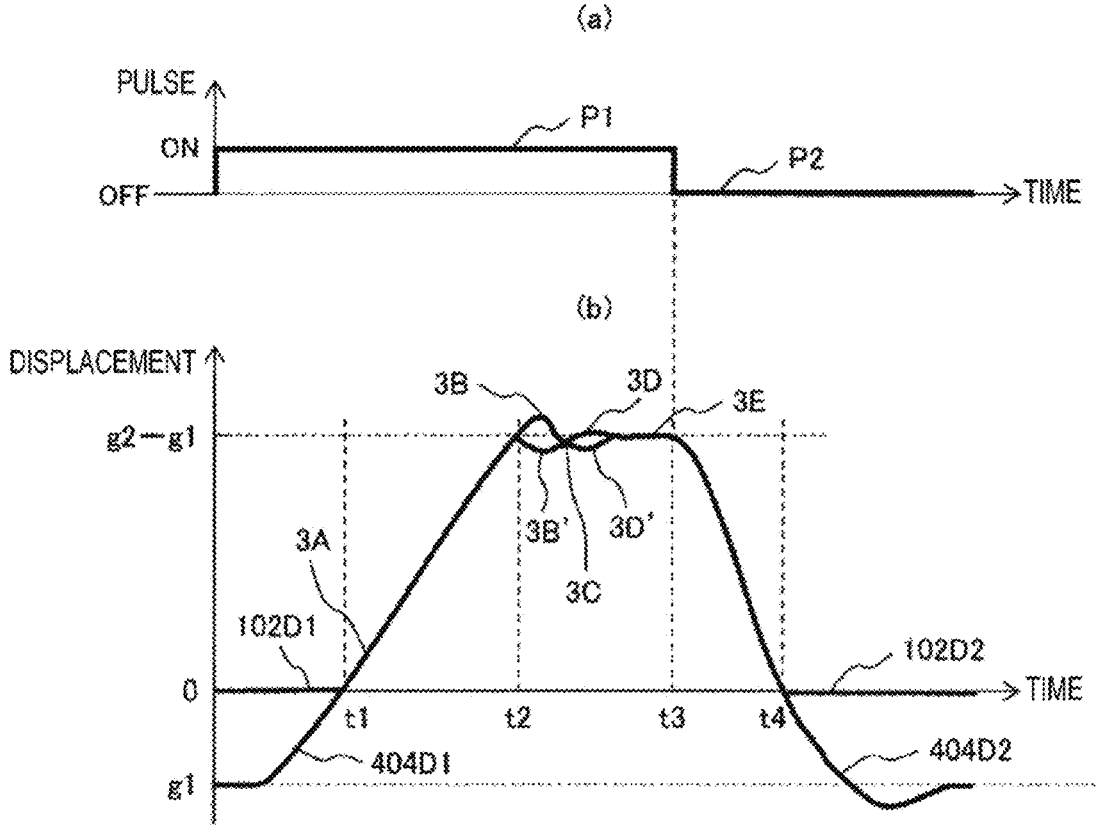
FIGS. 3(*a*) and 3(*b*) are views describing an operation of a movable unit corresponding to an injection command pulse according to embodiments of the present invention.

A configuration of a fuel injector 100 in a first embodiment according to the present invention will be described with reference to FIGS. 1 and 3. FIG. 1 is a sectional view illustrating a structure of the fuel injector according to the first embodiment of the present invention and is a vertical sectional view illustrating a cut surface parallel to a central axis line 100*a*. FIG. 2 is a sectional view enlarging an electromagnetic driving unit 400 illustrated in FIG. 1. FIGS. 3(*a*) and 3(*b*) are views describing a motion of a movable unit. FIG. 3(*a*) indicates an on-off state of an injection command pulse. FIG. 3(*b*) indicates a displacement of a plunger rod 102 and a movable iron core 404 in the case where a valve closing state of the plunger rod 102 is set to displacement zero.

The fuel injector 100 includes a fuel supply unit 200 for supplying a fuel, a nozzle unit 300 in which a valve unit 300*a* to allow and block fuel distribution is provided at a tip portion, and an electromagnetic driving unit 400 driving the valve unit 300*a*. In the embodiment, an electromagnetic fuel injector for an internal combustion engine which uses gasoline as a fuel is exemplified and described. The fuel supply unit 200, the valve unit 300*a*, the nozzle unit 300, and the electromagnetic driving unit 400 indicate a portion corresponding to a sectional surface described in FIG. 1 and do not indicate a single component.

In the fuel injector 100 according to the embodiment, the fuel supply unit 200 is provided on an upper end side on the drawing, the nozzle unit 300 is provided on a lower end side, and the electromagnetic driving unit 400 is provided between the fuel supply unit 200 and the nozzle unit 300. Specifically, along the central axis line 100*a* direction, the fuel supply unit 200, the electromagnetic driving unit 400, and the nozzle unit 300 are disposed in this order from an upper side.

An end portion on a side opposite to the nozzle unit 300 is connected to a fuel piping (not illustrated) in the fuel supply unit 200. In the nozzle unit 300, an end portion on a side opposite to the fuel supply unit 200 is inserted into an intake pipe (not illustrated) or a mounting hole (insertion hole) formed to a combustion chamber forming member (such as a cylinder block and a cylinder head) of an internal combustion engine. The electromagnetic fuel injector 100 receives fuel supply from a fuel piping through the fuel supply unit 200 and injects a fuel in the intake pipe or the combustion chamber from a tip portion of the nozzle unit 300. Fuel passages 101 (101*a* to 101*f*) are formed in the fuel injector 100 such that most fuel flow along the central axis line 100*a* of the electromagnetic fuel injector 100 from the end portion of the fuel supply unit 200 to the tip portion of the nozzle unit 300.

In a description below, regarding both end portions in a direction along the central axis line 100*a* of the fuel injector 100, an end portion and an end portion side of the fuel supply unit 200 positioned on a side opposite to the nozzle unit 300 is called a base end and a base end side, respectively, and an end portion and an end portion side of the nozzle unit 300 positioned on a side opposite to the fuel supply unit 200 is called a tip portion and a tip side, respectively. Further, based on a vertical direction in FIG. 1, each portion included in the electromagnetic fuel injector will be described by putting "upper" or "lower" to a name of the portion. This is to clarify the description and not to limit an embodiment of the electromagnetic fuel injector in an internal combustion engine to the vertical direction.

(Configuration Description)

Configurations of the fuel supply unit 200, the electromagnetic driving unit 400, and the nozzle unit 300 will be described below in detail.

As illustrated in FIG. 1, the fuel supply unit 200 includes a fuel pipe 201. A fuel supply port 201*a* is provided at one end portion (upper end portion) of the fuel pipe 201. On an inner side of the fuel pipe 201, the fuel passages 101*a* and 101*b* are formed so as to penetrate in a direction along the central axis line 100*a*. Another end portion (lower end portion) of the fuel pipe 201 is bonded to an end portion (upper end portion) of a fixed iron core 401.

An O-ring 202 and a back-up ring 203 are provided on an outer peripheral side of the upper end portion of the fuel pipe 201.

The O-ring 202 functions as a seal to prevent fuel leakage when the fuel supply port 201*a* is mounted to a fuel piping. Further, the back-up ring 203 is provided to back up the O-ring 202. The back-up ring 203 may be formed by laminating a plurality of ring-shaped members. A filter 204 to filter foreign substances mixed in a fuel is disposed on an inner side of the fuel supply port 201*a*.

The nozzle unit 300 includes a nozzle body 300*b*. The valve unit 300*a* is provided at a tip portion (lower end portion) of the nozzle body 300*b*. The nozzle body 300*b* is a hollow cylindrical body, and a fuel passage 101*f* is provided on an upper stream side of the valve unit 300*a*. A chip seal 103 to maintain airtightness when being mounted to an internal combustion engine is provided on an outer peripheral surface of a tip portion of the nozzle body 300*b*.

The valve unit 300*a* includes an injection hole forming member 301, a guide member 302, and a valve body 303 provided at one end (lower-side tip portion) of the plunger rod 102.

The injection hole forming member 301 includes a valve seat 301*a* and a fuel injection hole 301*b*. The valve seat 301*a* seals a fuel by being in contact with the valve body 303. The fuel injection hole 301*b* injects a fuel. The injection hole forming member 301 is inserted into and fixed to an inner peripheral surface of a recessed portion 300*ba* formed at a tip portion of the nozzle body 300*b*. At this time, an outer periphery of a tip surface of the injection hole forming member 301 and an inner periphery of a tip surface of the nozzle body 300*b* are welded and seal a fuel.

The guide portion 302 is disposed on an inner peripheral side of the injection hole forming member 301. The guide portion 302 is included in a guide surface on a tip side (lower end side) of the plunger rod 102 and guides movement of the plunger rod 102 in a direction (valve opening/closing direction) along the central axis line 100*a*.

The electromagnetic driving unit 400 includes the fixed iron core 401, a coil 402, a housing 403, a movable iron core 404, and an intermediate member 414, a plunger cap 410 including an upper end portion 410*c* and a lower end portion 410*d*, a first spring member 405, a second spring member 406, and a third spring member 407. The fixed iron core 401 is also called a fixed core. The movable iron core 404 is also called a movable core, a moving element, or an armature.

The fixed iron core 401 includes a fuel passage 101*c* at a center and includes a joint 401*a* with the fuel pipe 201 at an upper end portion. An outer peripheral surface 401*b* of the fixed iron core 401 is fitted and joined on an inner peripheral surface of a large diameter portion 300*c* of the nozzle body 300*b* and fitted and joined to an outer peripheral-side fixed iron core 401*d* on an outer peripheral surface 401*e* having a larger diameter than the outer peripheral surface 401*b*. The coil 402 is wound around the fixed iron core 401 and on an outer peripheral side of the large diameter portion 300*c* of a cylindrical member (the nozzle body 300*b*).

The housing 403 is provided so as to surround an outer peripheral side of the coil 402. The housing 403 forms an outer periphery of the electromagnetic fuel injector 100 and also forms a yoke of the electromagnetic driving unit 400. The upper end-side inner peripheral surface 403*a* of the housing 403 is joined on the outer peripheral surface 401*e* of the fixed iron core 401 and connected on an outer peripheral surface 401*f* of the outer peripheral-side fixed iron core 401*d*.

As illustrated in FIG. 2, the movable iron core 404 is disposed on a lower end surface 401*g* side of the fixed iron core 401. An upper end surface 404*c* of the movable iron core 404 faces the lower end surface 401*g* of the fixed iron core 401 with a gap g2 in a valve closing state. Further, an outer peripheral surface of the movable iron core 404 faces an inner peripheral surface of the large diameter portion 300*c* of the nozzle body 300*b* across a slight gap. The movable iron core 404 is movably disposed in a direction along the central axis line 100*a* on an inner side of the large diameter portion 300*c* of the cylindrical member 300*g*.

A magnetic path is formed such that a magnetic flux circulates to the fixed iron core 401, the movable iron core 404, the housing 403, and the large diameter portion 300*c* of the cylindrical member 300*g*. The movable iron core 404 is sucked in the fixed iron core 401 direction by a magnetic attractive force generated by a magnetic flux flowing between the lower end surface 401*g* of the fixed iron core 401 and the upper end surface 404*c* of the movable iron core 404.

A recessed portion 404*b* recessed on a lower end surface 404*a* side from the upper end surface 404*c* side is formed at a center of the movable iron core 404. A fuel passage hole 404*d* is formed as a fuel passage 101*d* on the upper end surface 404*c* and a bottom surface of the recessed portion 404*b*. The fuel passage hole 404*d* penetrates to the lower end surface 404*a* side in a direction along the central axis line 100*a*. Further, a through hole 404*e* is formed on a bottom surface of the recessed portion 404*b*. The through hole 404*e* penetrates to the lower end surface 404*a* side in a direction along the central axis line 100*a*. The plunger rod 102 is provided to insert the through hole 404*e*.

The plunger cap 410 is fixed to the plunger rod 102 by fitting, and the plunger rod 102 includes a wide diameter portion (large diameter portion) 102*a*. The intermediate member 414 is a cylindrical member including a recessed portion which becomes a step on inner and outer peripheries. A surface 414*a* on an inner peripheral side abuts on an upper surface 102*b* of the wide diameter portion 102*a* of the plunger rod to abut the outer periphery-side surface 414*b* on a bottom surface 404*b*' of a recessed portion of a movable iron core. A gap g1 is provided between a lower surface 102*c* of the wide diameter portion and the bottom surface 404*b*' of the recessed portion 404*b* of the movable iron core. The above-described gap g1 is a length obtained by subtracting a height h formed by the upper surface 102*b* and the lower surface 102*c* of the wide diameter portion of the plunger rod from a height 414*h* of a recessed portion step (a depth of the recessed portion) of the intermediate member 414. The intermediate member 414 is a gap forming member forming the gap g1 and includes a recessed portion recessed upward from a lower end surface side.

The lower surface 102*c* of the wide diameter portion 102*a* of the plunger rod 102 is included in a contact surface (contact portion) 102*c* being in contact with the bottom surface 404*b*' of the recessed portion 404*b* of the movable iron core while a valve is opened and closed. The bottom surface 404*b*' of the recessed portion 404*b* of the movable iron core is included in a contact surface (contact portion) 404*b*' being in contact with the lower surface 102*c* of the wide diameter portion 102*a* of the plunger rod 102 while a valve is opened and closed. When the lower surface 102*c* of the wide diameter portion 102*a* of the plunger rod 102 and the bottom surface 404*b*' of the recessed portion 404*b* of the movable iron core are in contact with each other, forces in valve opening/closing directions are mutually transmitted. When a valve is opened, the bottom surface 404*b*' of the recessed portion 404*b* of the movable iron core is in contact with the lower surface 102*c* of the wide diameter portion 102*a* of the plunger rod 102. Accordingly, a magnetic attractive force in a valve opening direction received by the movable iron core 404 is transmitted to the plunger rod 102. On the other hand, when a valve is closed, the lower surface 102*c* of the wide diameter portion 102*a* of the plunger rod 102 is in contact with the bottom surface 404*b*' of the recessed portion 404*b* of the movable iron core. Accordingly, an energizing force in a valve closing direction acting on the plunger rod 102 by the first spring member 405 is transmitted to the movable iron core 404. A lower surface (contact surface) 102*c* of the wide diameter portion 102*a* of the plunger rod 102 functions as a restriction portion to restrict relative displacement toward a valve opening direction of the movable iron core 404.

An upper end portion of the first spring member 405 is in contact with a lower end surface of the spring force adjusting member 106, and a lower end portion of the first spring member 405 is in contact with an upper spring receiver 410*a* of the plunger cap 410. As a result, the first spring member 405 energizes the plunger rod 102 downward (in a valve closing direction) via the plunger cap 410.

An upper end portion of the second spring member 406 is in contact with a lower spring receiver 410*b* of the plunger cap 410, and a lower end portion of the second spring member 406 is in contact with an upper surface 414*c* of the intermediate member 414. As a result, the second spring member 406 energizes the intermediate member 414 downward (in a valve closing direction).

An upper end portion of the third spring member 407 is in contact with the lower surface 404*a* of the movable iron core 404, and a lower end portion of the third spring 407 is in contact with a step 300*d* in a diameter direction of the nozzle body 300*b*. As a result, the third spring member 407 energizes the movable iron core 404 upward (in a valve opening direction).

In energizing forces of the first spring member 405, the second spring member 406, and the third spring member 407, an energizing force of the first spring member 405 is the largest, the energizing force of the second spring member 406 is largest next to the energizing force of the first spring member, and the energizing force of the third spring member 407 is the smallest.

The coil 402 is wound around a bobbin and assembled in the fixed iron core 401 and on an outer peripheral side of the wide diameter portion 300*b* of a cylindrical member, and a resin material is molded therearound. By a resin material 105*a* to be used for the molding, a connector 105 including a terminal 104 pulled out from the coil 402 is integrally molded.

(Motion Description)

Next, motions of the fuel injector 100 according to the embodiment and characteristics of the embodiment according to the present invention will be described. Mainly, the motions and characteristics will be described with reference to FIGS. 2 and 3(*a*) and 3(*b*). FIG. 2 is an enlarged view of the electromagnetic driving unit 400. FIGS. 3(*a*) and 3 (*b*) are views describing motions of a movable unit.

(Definition of Valve Closing State, Description of Gap)

In a valve closing state in which the coil 402 is not energized, by a force obtained by subtracting an energizing force of the third spring member 407 from an energizing force of the first spring member 405 energizing the plunger rod 102 in a valve closing direction, the plunger rod 102 is brought into contact with the valve seat 301*a*, and a valve is closed. This state is called a valve closing/resting state. At this time, the movable iron core 404 is in contact with a lower end surface of an outer peripheral-side step (an outer peripheral wall forming a recessed portion) 414*b* of the intermediate member 414 and disposed at a valve closing position.

In a valve closing state of the fuel injector according to the embodiment, a gap related to a movable component according to a valve opening motion is configured as described below. A gap g2 is included between the upper end surface 404*c* of the movable iron core 404 and the lower end surface 401*g* of the fixed iron core 401. The gap g1 is included between the plane 404*b*' of the recessed portion 404*b* of the movable iron core 404 and a lower surface 102*c* of a wide diameter portion of a plunger rod. The gap g2 is larger than the gap g1. As to be described below, the gap g1 is to form an approach section of the movable iron core 404 to make a rising of displacement of the plunger rod 102 steep when a valve is opened, and the gap g1 may be a preliminary stroke.

(Motion after Energization)

After energization to the coil 402 (P1), an electromagnet including the fixed iron core 401, the coil 402, and the housing 403 generates a magnetomotive force. By the magnetomotive force, a magnetic flux flows in a magnetic path including the fixed iron core 401 surrounding the coil 402, the housing 403, the wide diameter portion 300*d* of a nozzle body, and the movable iron core 404. At this time, a magnetic attractive force acts between the upper end surface 404*c* of the movable iron core 404 and the lower end surface 401*g* of the fixed iron core 401, and the movable iron core 404 and the intermediate member 414 are displaced toward the fixed iron core 401. Then, the movable iron core 404 is displaced by the gap g1 to come into contact on the lower surface 102*c* of a wide diameter portion of a plunger rod (404D1). In this case, the plunger rod 102 does not move (102D1).

Then, when the movable iron core 404 is in contact with the lower surface 102*c* of the wide diameter portion of a plunger rod at a timing t1, the plunger rod 102 receives an impact force from the movable iron core 404 and pulled up, and the plunger rod 102 is separated from the valve seat 301*a*. Consequently, a gap is formed in the valve seat portion, and a fuel passage opens. To start valve opening by receiving the impact force, rising of the plunger rod 102 becomes steep (3A).

Then, when the plunger rod 102 displaces by a distance obtained by subtracting the gap g1 from the gap g2, and the upper surface 404*c* of the movable iron core 404 comes into contact with the lower surface 401*g* of the fixed iron core 401 at the timing t2, the plunger rod 102 is further displaced upward by an inertial force (3B), and the movable iron core 404 is bounced by collision with the lower surface 401*g* of the fixed iron core 401 and displaced downward (3B').

Then, the plunger rod 102 is pushed back by the first spring member 405, and the movable iron core 404 is pulled back by a magnetic attractive force. When the movable iron core 404 is pulled back by the magnetic attractive force, the movable iron core 404 and the intermediate member 414 are separated, and the movable iron core 404 is pushed by an energizing force of the third spring member 407 without receiving an energizing force of the second spring member.

Then, the movable iron core 404 and the intermediate member 414 are in contact with each other, and the movable iron core 404 and the plunger rod 102 come in contact with each other when the movable iron core 404 is relatively displaced by a distance of the gap g1 with respect to the plunger rod 102. While the movable iron core 404 is relatively displaced by a distance of the gap g1 with respect to the plunger rod 102, the movable iron core 404 receives an energizing force in a valve closing direction by the second spring member 406 via the intermediate member 414. As a result, an impact force of the movable iron core 404 to the plunger rod 102 or the fixed core 401 is reduced.

After the movable iron core 404 and the plunger rod 102 again come into contact with each other (3C) and are again separated, and the plunger rod is displaced upward (3D), and the movable iron core 404 is displaced downward (3D'). As described above, before the movable iron core 404 again collides with the plunger rod 102, an impact force of the movable iron core 404 to the plunger rod 102 is reduced by the second spring member 406. Therefore, bounds indicated by 3D and 3D' are suppressed.

Then, the displacement is stabilized to a distance obtained by subtracting the gap g1 from the gap g2 (3E). A time when an energizing force in a valve closing direction by the second spring member 406 acts on the movable core 404 moving toward the fixed core 401 is limited to a time when the movable iron core 404 is relatively displaced by a distance of the gap g1 with respect to the plunger rod 102. Therefore, a time up to a stable state is not unnecessarily extended.

(Act, Effect)

In the embodiments according to the present invention, the intermediate member 414 is disposed on a lower side of the second spring member 406 which generates a spring force to the movable iron core 404 and the plunger rod 102. The intermediate member 414 is disposed by being in contact on the recessed surface 404*b*' of the movable iron core 404 and the upper surface 102*b* of a wide diameter portion of the plunger rod 102. Therefore, the movable iron core 404, the plunger rod 102, and the intermediate member 414 open a valve, and when the movable iron core 404 collides with the fixed iron core 401 at the timing t2, the movable iron core 404 moves downward, but the intermediate member 414 and the plunger rod 102 continuously move upward. In this state, a spring force of the second spring member 406 does not act between the movable iron core 404 and the plunger rod 102, and a spring force acting on the movable iron core 404 and a spring force acting on the plunger rod 102 are separated. Therefore, a spring force of the second spring member 406, which changes with a movement of the movable iron core 404 is not transmitted to the plunger rod 102. On the other hand, a spring force of the second spring member 406 which changes with a movement of the plunger rod 102 is not transmitted to the movable iron core 404. Accordingly, each of the movable iron core 404 and the plunger rod 102 independently oscillates in association with collision (3B, 3B'). Further, when those collides again (3C), the movable iron core 404 bounds downward (3D'), and the plunger rod 102 bounds upward (3D). Therefore, the movable iron core 404 and the plunger rod 102 do not exert forces to each other. Specifically, the movable iron core 404 and the plunger rod 102 move without acting a spring force of the second spring member 406 which changes with movements of each other. Further, the plunger rod 102 and the movable iron core 404 have small forces when bouncing as indicated by 3D and 3D'. Therefore, in comparison with the case where a spring force of the second spring member 406 is acting which changes with the movement of each other, bound convergence of a movable component is promoted (3E). As a result of the effect, a fuel injection amount can be stabilized.

Further, in a valve closing state, the gap g1 in which the movable element 404 displaces is formed by a difference between the recessed portion height 414*h* of the intermediate member 414 and the height h of the wide diameter portion of the plunger rod (the height h of the upper surface 102*b* and the lower surface 102*c* of the wide diameter portion 102*a*). Therefore, the gap g1 in which the movable element 404 displaces can be determined by a component dimension, and adjustment in an assembling process becomes unnecessary, and the assembling process can be simplified.

When energization to the coil 402 is blocked at a timing t3 (P2), a magnetic force starts to eliminate, and a valve is closed by a downward energizing force of the spring. After displacement of the plunger rod 102 becomes zero at a timing t4, valve closing is completed when the plunger rod comes into contact with the valve seat 301*a* (102D2). The movable iron core 404 stops at a position of the gap g1 after displacing downward from the gap g1 by an inertial force (404D2).

Further, in a configuration of the embodiment, an outer diameter 414D of the intermediate member 414 is smaller than an inner diameter 401D of a fixed iron core. Therefore, when a fuel injector is assembled, in a state in which the spring force adjusting member 106 and the first spring member 405 are not inserted after the gap g1 is determined by a step height 414*h* of the intermediate member 414 and the height h of a wide diameter portion of a plunger rod, the plunger cap 410, the plunger rod 102, the second spring member 406, and the intermediate member 414 can be integrated beforehand and assembled into the fuel injector. Therefore, while simplifying the assembly, the gap g1 can be stably managed. In the embodiment, the wide diameter portion 414D of the intermediate member 414 is set to be smaller than the inner diameter 401D of the fixed iron core 401. However, preferably, the outermost diameter of a member to be assembled is set to be small. If an outermost diameter of the plunger cap 410 is larger than the outermost diameter 414D of the intermediate member, the outermost diameter of the plunger cap 410 may be set to be smaller than the inner diameter 401D of the fixed iron core 401.

Further, in the embodiment, the plunger cap 410 is press-fitted to an upper portion of the plunger rod 102 and may not be welded. Since the light intermediate member 414 collides with the lower end portion 410*d* of the plunger cap 410, an impact force is small, and the plunger cap 410 can be fixed by press-fitting only. In this manner, a dimension variation by expansion of a component, which is generated by welding, can be suppressed, and a variation of a setting load of the second spring member 406 can be suppressed.

In the embodiment, even if the recessed portion 404*b* of a movable iron core is not included, and a contact surface 404*b*' in valve opening/closing directions to the plunger rod 102 is on the same surface with the upper surface 404*c*, same action effects as in the embodiment can be obtained. By providing the recessed portion 404*b* of the movable iron core 404, the intermediate member 414 can be disposed on a lower side, and a length in a vertical direction of the plunger rod 102 can be shortened. As a result, the highly accurate plunger rod 102 can be formed.

Second Embodiment

Figure 4:
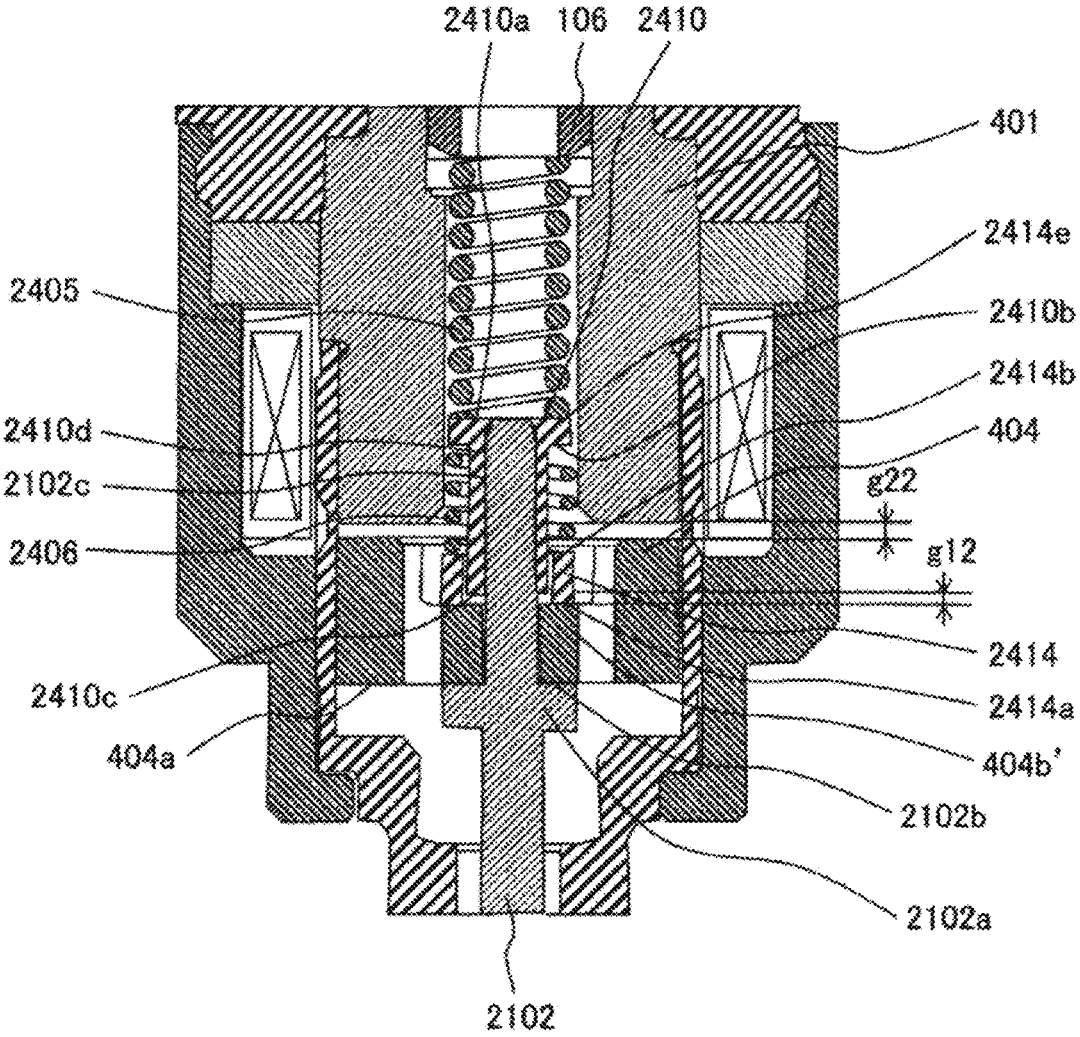
FIG. 4 is a sectional view illustrating a structure of a fuel injector according to a second embodiment of the present invention and a sectional view enlarging an electromagnetic driving unit of the fuel injector.

A second embodiment according to the present invention will be described with reference to FIG. 4. FIG. 4 is a sectional view illustrating a structure of a fuel injector according to the second embodiment and a sectional view enlarging an electromagnetic driving unit of the fuel injector. In FIG. 4, components denoted by same numbers as in the first embodiment have same configuration action effects, and therefore descriptions thereof will be omitted.

The second embodiment is different from the first embodiment in points that two spring members including a first spring member 2405 and a second spring member 2406 are included, an intermediate member 2414 has a cylindrical shape and comes into contact with a bottom surface 404*b*' of a recessed portion of a movable iron core 404, a lower surface 404*a* of the movable iron core 404 comes into contact with an upper surface 2102*b* of a wide diameter portion 2102*a* of a plunger rod, and a gap (preliminary stroke) g12 formed by the movable iron core 404 with a plunger rod 2102 in a valve closing state is formed at a lower end portion 2410*c* of a plunger cap 2410.

The plunger cap 2410 is fixed by press-welding an inner peripheral surface 2410*d* to an outer peripheral portion 2102*c* of the plunger rod 2102.

The first spring member 2405 is in contact with a spring force adjusting member 106 and an upper surface 2410*a* of the plunger cap and energizes the plunger rod 2102 downward (in a valve closing direction) via the plunger cap 2410. The second spring member 2406 is in contact with the lower surface 2410*b* of the plunger cap 2410 and an upper surface 2414*b* of the intermediate member 2414, and energizes the intermediate member 2414 downward.

The intermediate member 2414 is energized downward by the second spring member 2406 and comes into contact with the bottom surface 404*b*' of a recessed portion of the movable element 404.

The gap g12 formed by the movable iron core 404 and the plunger cap 2410 in a valve closing state is determined by a press-fitting amount to the plunger rod 2102 of the plunger cap 2410. A gap g22 formed by an upper surface 404*c* of the movable iron core 404 and a lower surface 401*g* of a fixed iron core 401 can be adjusted by moving a plunger rod 2012 and the movable iron core 404 upward at the same time and adjusting a press-in amount of the injection hole forming member 301 when the injection hole forming member 301 illustrated in FIG. 1 is inserted into an inner peripheral surface of a recessed portion 300*ba* formed at a tip portion of a nozzle body 300*b*.

In the embodiment, a member which collides with the movable iron core 404 is the plunger cap 2410. A material of the plunger cap 2410 is not so restricted, and the degree of freedom to select the material is high. Therefore, a material advantageous to suppress wear assumed to generate by collision can be used, and durability can be improved. Further, the gaps g12 and g22 formed in the fuel injector do not have a dimension of a single component and can be determined in an adjustment process for component assembly. Accuracy request with respect to a single component can be relieved, and components can be simplified and manufacturing costs can be reduced.

According to the present invention, when the movable iron core 404 collides with the fixed iron core 401, the movable iron core 404 moves downward. However, the intermediate member 2414 and the plunger rod 2102 continuously move upward. In this state, a spring force of the second spring member 2406 does not act between the movable iron core 404 and the plunger rod 102, and a spring force acting on the movable iron core 404 and a spring force acting on the plunger rod 102 are separated. Therefore, a spring force of the second spring member 2406, which changes with a movement of the movable iron core 404, is not transmitted to the plunger rod 2102. On the other hand, a spring force of the second spring member 2406, which changes with a movement of the plunger rod 2102, is not transmitted to the movable iron core 404. Therefore, the movable iron core 404 and the plunger rod 102 independently oscillate in association with the collision without exerting forces to each other. Therefore, a force acting on a movable component is reduced, and a bound convergence is promoted. As a result of the effect, a fuel injection amount can be stabilized.

Third Embodiment

Figure 5:
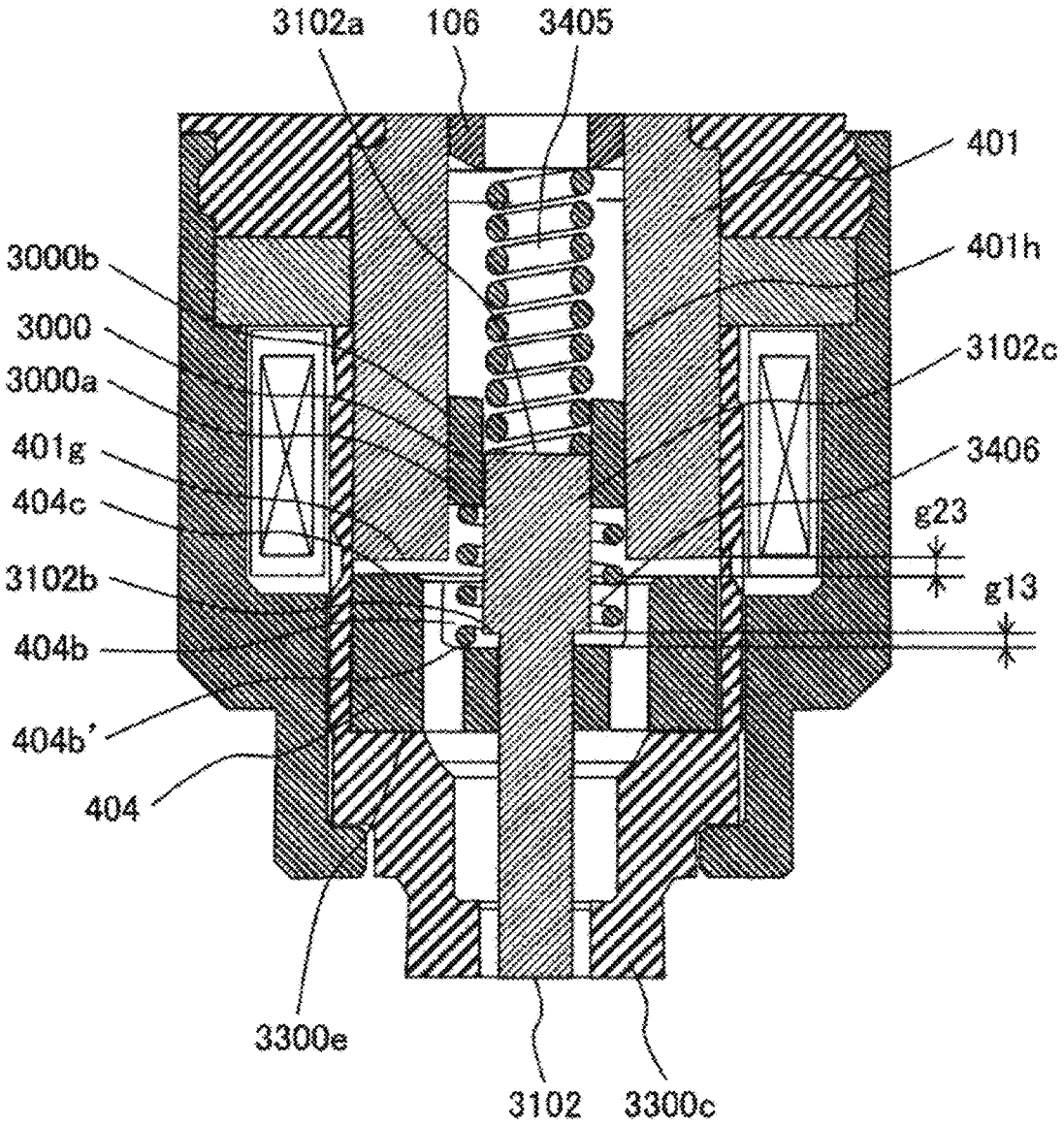
FIG. 5 is a sectional view illustrating a structure of a fuel injector according to a third embodiment of the present invention and a sectional view enlarging an electromagnetic driving unit of the fuel injector.

A third embodiment according to the present invention will be described with reference to FIG. 5. FIG. 5 is a sectional view illustrating a structure of a fuel injector according to the embodiment and a sectional view enlarging an electromagnetic driving unit of the fuel injector. In FIG. 5, components denoted by same numbers as in the first embodiment have same configuration action effects, and therefore descriptions thereof will be omitted.

The third embodiment is different from the first and second embodiments in a point that spring forces of a plunger rod 3102 and a movable iron core 404 are always separated. Two spring members including a first spring member 3405 and a second spring member 3406 are included. An intermediate member is not included. A ring-shaped member 3000 fixed to a fixed iron core is included.

The ring-shaped member 3000 is press-fitted to an inner peripheral portion 401*h* of a fixed iron core 401 by an outer peripheral portion 3000*b* of the ring-shaped member 3000. Specifically, the outer peripheral surface 3000*b* of the ring-shaped member 3000 is abutted and fixed on the inner peripheral surface 401*h* of the fixed iron core 401 by press-fitting the ring-shaped member 3000 to a through hole 401*h* formed to the fixed iron core 401 in a central axis line 100*a* direction.

In a valve closing state, the movable iron core 404 includes a gap g13 in a displacement direction between a lower surface 3102*b* of a wide diameter portion 3102*c* formed at an upper end portion of the plunger rod 3102 and the movable iron core 404. Further, a gap g23 in the displacement direction is included between an upper surface 404*c* of the movable iron core 404 and a lower surface 401*g* of the fixed iron core 401.

The first spring member 3405 is in contact with a spring force adjusting member 106 and an upper surface 3102*a* of a plunger rod and energizes the plunger rod 3102 downward (in a valve closing direction). The second spring member 3406 is in contact with a lower surface 3000*a* of the ring-shaped member 3000 and a bottom surface 404*b*' of a recessed portion 404*b* of the movable iron core 404 and energizes the movable iron core 404 downward. Further, the movable iron core 404 is in contact with a step 3300*e* of a nozzle body 3300*c* in a valve closing state.

In the embodiment, when the movable iron core 404 and the plunger rod 3102 move in an opposite direction after the movable iron core 404 collides with the fixed iron core 401 when a valve is opened, a spring force is not generated between the movable iron core 404 and the plunger rod 3102, a spring force is separated.

Therefore, in the case where the movable iron core 404 moves downward, and the plunger rod 3102 continuously moves upward after the movable iron core 404 collides with the fixed iron core 401, a spring force does not act between the movable iron core 404 and the plunger rod 3102. Therefore, a spring force which changes with a movement of the movable iron core 404 is not transmitted to the plunger rod 2102. On the other hand, a spring force which changes with a movement of the plunger rod 2102 is not transmitted to the movable iron core 404 at any time. Therefore, the plunger rod 2102 and the movable iron core 404 oscillate in association with collision without exerting forces to each other. Therefore, a force acting on a movable component is reduced, and a bound convergence can be promoted. As a result of the effect, a fuel injection amount can be stabilized.

A gap g13 formed by the movable iron core 404 with the lower surface 3102*b* of the wide diameter portion 3102*c* of the plunger rod 3102 in a valve closing state can be adjusted by adjusting a press-in amount when the injection hole forming member 301 illustrated in FIG. 1 is inserted into an inner peripheral surface of the recessed portion 300*ba* of the nozzle body 300*b*. A gap g23 formed by an upper surface 404*c* of the movable iron core 404 and a lower surface 401*g* of the fixed iron core 401 can be adjusted by adjusting a press-in amount of the fixed iron core 401 to the nozzle body 3300*c*.

In the embodiment, the lower surface 3000*a* of the ring-shaped member 3000 which is an upper contact position of the second spring member 3406 is positioned lower than the upper surface 3102*a* of the plunger rod 3102 which is a lower contact position of the first spring member 3405. As a result, springs are not parallelly disposed in a diameter direction from the central axis line 100*a* of a fuel injector and therefore can suppress entanglement of the springs during assembling and driving.

The present invention is not limited to each of the above-described embodiments and includes various variations. For example, the above-described embodiments describe the present invention in detail for clarification, and every configuration may not be necessarily included. Further, a configuration of an embodiment can be partially replaced with configurations of the other embodiments. Furthermore, a configuration of each embodiment can be added to configurations of the other embodiments. Further, a part of a configuration of each embodiment can be added to, deleted from, and replaced from other configurations.

REFERENCE SIGNS LIST

100 fuel injector
101 fuel passage

102, 2102, 3102 plunger rod
200 fuel supply unit
300 nozzle unit
301*a* valve seat
301*b* fuel injection hole
400 electromagnetic driving unit
401 fixed iron core
402 coil
403 housing
404 movable iron core
405, 2405, 3405 first spring member
406, 2406, 3406 second spring member
407 third spring member
410, 2410 plunger cap
414, 2414 intermediate member
3000 ring-shaped member

The invention claimed is:

1. A fuel injector, comprising:

a valve seat and a valve body configured to open and close a fuel passage in collaboration with each other;

a movable iron core provided relatively displaceable in valve opening/closing directions to the valve body;

a fixed iron core which generates a magnetic attractive force between end surfaces opposed to each other across the movable iron core and the fixed iron core;

a first spring member energizing the valve body in a valve closing direction;

a second spring member energizing the movable iron core in the valve closing direction;

a contact portion of the valve body and a contact portion of the movable iron core configured to restrict relative displacement of the movable iron core by being in contact with each other in a case where the movable iron core displaces in a valve opening direction with respect to the valve body;

a first gap provided in the valve opening/closing direction between the end surfaces opposed to each other across the movable iron core and the fixed iron core in a valve closing state; and a second gap provided in the valve opening/closing direction between the contact portion of the valve body and the contact portion of the movable iron core, wherein:

the second spring member is supported by a spring seat and includes a first end portion and a second end portion, the first end portion of the second spring member being in contact with the valve body, and an intermediate member energized in the valve closing direction by the second spring member when a lower end surface of the intermediate member is in contact with the movable iron core, and an upper end surface of the intermediate member is in contact with the second end portion of the second spring member.

2. A fuel injector, comprising:

a valve seat and a valve body of a valve configured to open and close a fuel passage in collaboration with each other;

a movable iron core provided relatively displaceable in valve opening/closing directions to the valve body;

a fixed iron core which generates a magnetic attractive force between end surfaces opposed to each other across the movable iron core and the fixed iron core;

a first spring member energizing the valve body in a valve closing direction;

a second spring member energizing the movable iron core in the valve closing direction;

a contact portion of the valve body and a contact portion of the movable iron core configured to restrict relative displacement of the movable iron core by being in contact with each other in a case where the movable iron core displaces in a valve opening direction with respect to the valve body;

a first gap provided in the valve opening/closing direction between the end surfaces opposed to each other across the movable iron core and the fixed iron core in a valve closing state; and a second gap provided in the valve opening/closing direction between the contact portion of the valve body and the contact portion of the movable iron core, wherein:

the first spring member and the second spring member are included such that a spring force does not act between the movable iron core and the valve body in a state in which the movable iron core moves in the valve closing direction, and the valve body moves in the valve opening direction after the movable iron core collides with the fixed iron core while the valve is opened, the second spring member is supported by a spring seat, wherein one end portion of the second spring member is in contact with the valve body, an intermediate member energized in the valve closing direction by the second spring member when a lower end surface of the intermediate member is in contact with the movable iron core, and an upper end surface of the intermediate member is in contact with another end portion of the second spring member, and in the state in which the movable iron core moves in the valve closing direction, and the valve body moves in the valve opening direction after the movable iron core collides with the fixed iron core while the valve is opened, an energizing force of the second spring member is not applied to the movable iron core by separating a lower end surface of the intermediate member from the movable iron core.

3. The fuel injector according to claim 2, wherein the intermediate member includes an outer peripheral wall portion forming a recessed portion, and the second gap is formed by a height of a step formed by the recessed portion.

4. The fuel injector according to claim 1, wherein an upper side supporting position, which is positioned on a side opposite to the movable iron core, of the second spring member energizing the movable iron core is positioned on a lower side from a supporting position on a valve body side of the first spring member energizing the valve body.

5. The fuel injector according to claim 1, wherein in the state in which the movable iron core moves in the valve closing direction, and the valve body moves in the valve opening direction after the movable iron core collides with the fixed iron core while in a valve open state, an energizing force of the second spring member is not applied to the movable iron core by separating a lower end surface of the intermediate member from the movable iron core.

6. The fuel injector according to claim 1, wherein, the first spring member and the second spring member are included such that a spring force does not act between the movable iron core and the valve body in a state in which the movable iron core moves in the valve closing direction, and the valve body moves in the valve opening direction after the movable iron core collides with the fixed iron core while in a valve open state.

7. The fuel injector according to claim 1, wherein the intermediate member includes an outer peripheral wall portion forming a recessed portion, and the second gap is formed by a height of a step formed by the recessed portion.

8. The fuel injector according to claim 2, wherein an upper side supporting position, which is positioned on a side opposite to the movable iron core, of the second spring member energizing the movable iron core is positioned on a lower side from a supporting position on a valve body side of the first spring member energizing the valve body.

* * * * *